US009178278B2

(12) United States Patent
Zhu et al.

(10) Patent No.: US 9,178,278 B2
(45) Date of Patent: Nov. 3, 2015

(54) DISTRIBUTED LOOP ANTENNAS WITH EXTENDED TAILS

(75) Inventors: Jiang Zhu, Sunnyvale, CA (US); Jerzy Guterman, Mountain View, CA (US); Mattia Pascolini, San Mateo, CA (US); Robert W. Schlub, Cupertino, CA (US); Jayesh Nath, Santa Clara, CA (US); Enrique Ayala Vazquez, Watsonville, CA (US); Jonathan Haylock, Los Angeles, CA (US); Boon W. Shiu, San Jose, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 811 days.

(21) Appl. No.: 13/299,123

(22) Filed: Nov. 17, 2011

(65) Prior Publication Data

US 2013/0127672 A1 May 23, 2013

(51) Int. Cl.
*H01Q 7/00* (2006.01)
*H01Q 1/22* (2006.01)

(52) U.S. Cl.
CPC ..... *H01Q 7/00* (2013.01); *H01Q 1/2266* (2013.01)

(58) Field of Classification Search
CPC ..... H01Q 7/00; H01Q 1/2266
USPC ..... 343/866, 702, 741
See application file for complete search history.

(56) References Cited

U.S. PATENT DOCUMENTS 3,560,983 A * 2/1971 Willie et al. ..... 343/744
4,814,776 A 3/1989 Caci et al.
6,429,818 B1 8/2002 Johnson et al.
6,661,380 B1 * 12/2003 Bancroft et al. ..... 343/700 MS
6,784,843 B2 8/2004 Onaka et al.
7,205,942 B2 4/2007 Wang et al.
7,342,498 B2 * 3/2008 Baba et al. ..... 340/572.5
7,701,395 B2 4/2010 Alvey et al.
7,830,320 B2 11/2010 Shamblin et al.

(Continued)

FOREIGN PATENT DOCUMENTS

EP 1649546 4/2006
WO 2011076582 6/2011

OTHER PUBLICATIONS

Zhu et al., U.S. Appl. No. 13/216,012, filed Aug. 23, 2011.

(Continued)

*Primary Examiner* — Dieu H Duong
(74) *Attorney, Agent, or Firm* — Treyz Law Group; G. Victor Treyz; Michael H. Lyons

(57) ABSTRACT

Electronic devices may be provided with antenna structures such as distributed loop antenna resonating element structures. A distributed loop antenna may be formed on an elongated dielectric carrier and may have a longitudinal axis. The distributed loop antenna may include a loop antenna resonating element formed from a sheet of conductive material that extends around the longitudinal axis. A gap may be formed in the sheet of conductive material. The gap may be located under an opaque masking layer on the underside of a display cover glass associated with a display. The loop antenna resonating element may have a main body portion that includes the gap and may have an extended tail portion that extends between the display and conductive housing structures. The main body portion and extended tail portion may be configured to ensure that undesired waveguide modes are cut off during operation of the loop antenna.

14 Claims, 9 Drawing Sheets

(56) References Cited

U.S. PATENT DOCUMENTS

| | | | | |
|---|---|---|---|---|
| 7,973,722 | B1 | 7/2011 | Hill et al. | |
| 7,982,616 | B2 | 7/2011 | Banerjee et al. | |
| 2002/0163470 | A1* | 11/2002 | Nagumo et al. | 343/700 MS |
| 2006/0055618 | A1* | 3/2006 | Poilasne et al. | 343/866 |
| 2008/0129637 | A1* | 6/2008 | Chi et al. | 343/866 |
| 2010/0072287 | A1 | 3/2010 | Kai et al. | |
| 2010/0238072 | A1 | 9/2010 | Ayatollahi et al. | |

OTHER PUBLICATIONS

Zhu et al., U.S. Appl. No. 13/216,073, filed Aug. 23, 2011.

* cited by examiner

DISTRIBUTED LOOP ANTENNAS WITH EXTENDED TAILS

BACKGROUND

This relates generally to electronic devices and, more particularly, to electronic devices with antennas.

Electronic devices such as computers are often provided with antennas. For example, a computer monitor with an integrated computer may be provided with antennas that are located along an edge of the monitor.

Challenges can arise in mounting antennas within an electronic device. For example, the relative position between an antenna and surrounding device structures and the size and shape of antenna structures can have an impact on antenna tuning and bandwidth. If care is not taken, an antenna may become detuned or may exhibit an undesirably small efficiency bandwidth at desired operating frequencies.

It would therefore be desirable to be able to provide improved antennas for use in electronic devices.

SUMMARY

Electronic devices may be provided with antenna structures such as distributed loop antenna resonating element structures. A distributed loop antenna may be formed on an elongated dielectric support structure and may have a longitudinal axis. The distributed loop antenna may include a loop antenna resonating element formed from a sheet of conductive material that extends around the longitudinal axis. A gap may be formed in the sheet of conductive material. The gap may be located under an opaque masking layer on the underside of a display cover glass associated with a display.

The loop antenna resonating element may have a main body portion on which the gap is formed and may have an extended tail portion. The extended tail portion may extend between the display and conductive housing structures for an electronic device. The main body portion and extended tail portion may be configured to ensure that undesired waveguide modes are cut off during operation of the loop antenna.

Further features of the invention, its nature and various advantages will be more apparent from the accompanying drawings and the following detailed description of the preferred embodiments.

DETAILED DESCRIPTION

Electronic devices may be provided with antennas and other wireless communications circuitry. The wireless communications circuitry may be used to support wireless communications in multiple wireless communications bands. One or more antennas may be provided in an electronic device. For example, antennas may be used to form an antenna array to support communications with a communications protocol such as the IEEE 802.11(n) protocol that uses multiple antennas.

Figure 1:
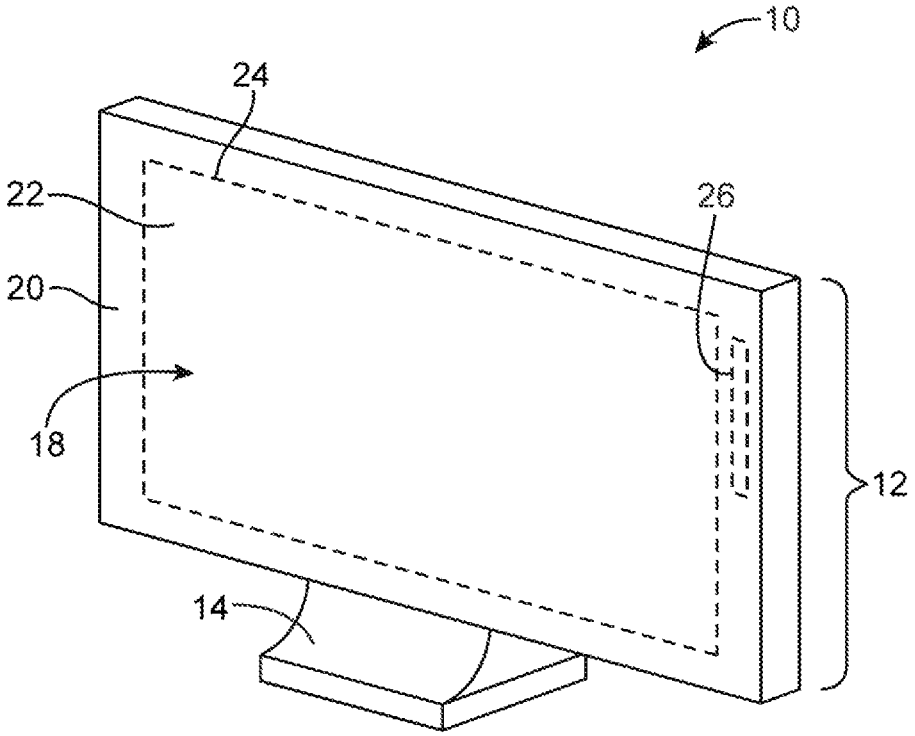
FIG. 1 is a perspective view of an illustrative electronic device with antenna structures in accordance with an embodiment of the present invention.

An illustrative electronic device of the type that may be provided with one or more antennas is shown in FIG. 1. Electronic device 10 may be a computer such as a computer that is integrated into a display such as a computer monitor. Electronic device 10 may also be a laptop computer, a tablet computer, a somewhat smaller portable device such as a wrist-watch device, pendant device, headphone device, earpiece device, or other wearable or miniature device, a cellular telephone, a media player, or other electronic equipment. Illustrative configurations in which electronic device 10 is a computer formed from a computer monitor are sometimes described herein as an example. In general, electronic device 10 may be any suitable electronic equipment.

Antennas may be formed in device 10 in any suitable location such as location 26. The antennas in device 10 may include loop antennas, inverted-F antennas, strip antennas, planar inverted-F antennas, slot antennas, cavity antennas, hybrid antennas that include antenna structures of more than one type, or other suitable antennas. The antennas may cover cellular network communications bands, wireless local area network communications bands (e.g., the 2.4 and 5 GHz bands associated with protocols such as the Bluetooth® and IEEE 802.11 protocols), and other communications bands. The antennas may support single band and/or multiband operation. For example, the antennas may be dual band antennas that cover the 2.4 and 5 GHz bands. The antennas may also cover more than two bands (e.g., by covering three or more bands or by covering four or more bands).

Conductive structures for the antennas may, if desired, be formed from conductive electronic device structures such as conductive housing structures, from conductive structures such as metal traces on plastic carriers, from metal traces in flexible printed circuits and rigid printed circuits, from metal foil supported by dielectric carrier structures, from wires, and from other conductive materials.

Device 10 may include a display such as display 18. Display 18 may be mounted in a housing such as electronic device housing 12. Housing 12 may be supported using a stand such as stand 14 or other support structure.

Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Display 18 may be a touch screen that incorporates capacitive touch electrodes or other touch sensor components or may be a display that is not touch sensitive. Display 18 may include image pixels formed from light-emitting diodes (LEDs), organic LEDs (OLEDs), plasma cells, electrophoretic ink elements, electrowetting display elements, liquid crystal display (LCD) components, or other suitable image pixel structures.

A display cover layer such as a layer of cover glass or a plastic cover layer may cover the surface of display 18. Rectangular active region 22 of display 18 may lie within rectangular boundary 24. Active region 22 may contain an array of image pixels that display images for a user. Active region 22 may be surrounded by an inactive peripheral region such as rectangular ring-shaped inactive region 20. The inactive portions of display 18 such as inactive region 20 are devoid of active image pixels. Display driver circuits, antennas (e.g., antennas in regions such as region 26), and other components that do not generate images may be located under inactive region 20.

The cover layer for display 18 may cover both active region 22 and inactive region 20. The inner surface of the cover layer in inactive region 20 may be coated with a layer of an opaque masking material such as opaque plastic (e.g., a dark polyester film) or black ink. The opaque masking layer may help hide internal components in device 10 such as antennas, driver circuits, housing structures, mounting structures, and other structures from view.

Antennas mounted in region 26 under an inactive portion of the display cover layer may transmit and receive signals through the display cover layer. This allows the antennas to operate, even when some or all of the structures in housing 12 are formed from conductive materials. For example, mounting the antenna structures of device 10 in region 26 under part of inactive region 20 may allow the antennas to operate even in arrangements in which some or all of the walls of housing 12 are formed from a metal such as aluminum or stainless steel (as examples).

Figure 2:
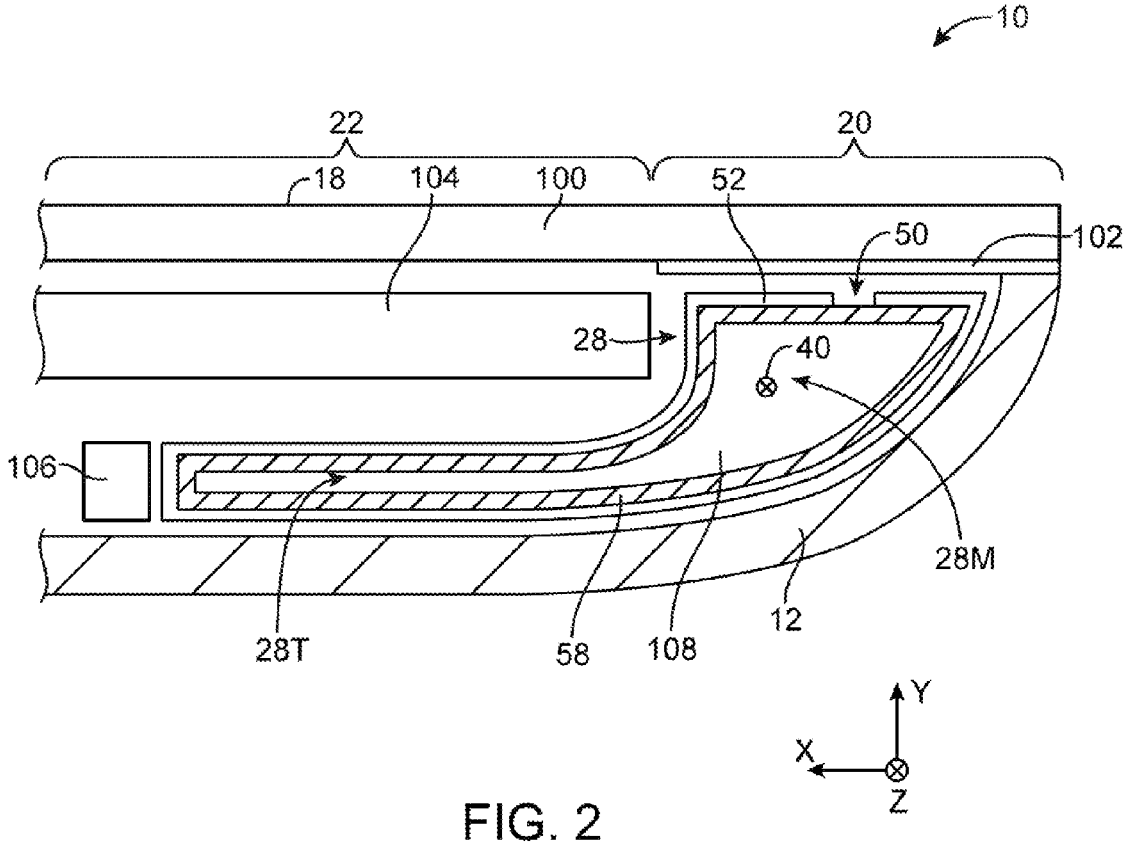
FIG. 2 is a cross-sectional side view of illustrative antenna structures mounted within an illustrative electronic device in accordance with an embodiment of the present invention.

A cross-sectional side view of an illustrative antenna mounted in an electronic device such as device 10 of FIG. 1 is shown in FIG. 2. As shown in FIG. 2, display 18 may be covered with display cover layer 100 (e.g., a layer of cover glass or plastic). Opaque masking layer 102 may be formed on the underside of display cover layer 100 to cover internal device components such as antenna 28 from view. Display module 104, which may contain an array of active image pixels, may be used to generate images in active region 22.

Internal device components such as display module 104, conductive foam 106, integrated circuits, discrete components such as resistors, capacitors, and inductors, connectors, sensors, audio components such as microphones and speakers, components mounted on one or more printed circuits, other electronic equipment, and other structures in device 10 may, in combination with portions of housing 12 such as the curved sidewalls of housing 12 that are shown in FIG. 2 or other device structures, create a volume within which antenna 28 may be mounted. The volume may have conductive interior surfaces such as metal portions of display module 104, conductive foam 106, and conductive sidewall 12. The volume may have a main portion that receives main antenna body 28M and a thinner extended portion that receives extended tail portion 28T of antenna 28. The inclusion of tail portion 28T may allow antenna 28 to be mounted within compact interior locations within device 10 such as locations in which extended tail portion 28T is interposed between display 18 (e.g., display module 104) and housing 12 (e.g., a metal housing wall), while exhibiting a satisfactory efficiency bandwidth at desired operating frequencies.

One or more antennas such as antenna 28 may be mounted within housing 12. In the illustrative configuration of FIG. 2, antenna 28 has a shape that allows antenna 28 to fit within the confines of housing 12 and surrounding device components so that main portion 28M is located under black ink 102 and inactive region 20 (e.g., region 26 of FIG. 1) of display 18 and so that tail portion 28T is located between display module 104 and housing 12, under module 104 in active region 22 of display 18. Other suitable mounting locations in device 10 include positions behind dielectric antenna windows, etc. In configurations in which device 10 uses a curved housing sidewall shape or other shapes that provide relatively small amounts of interior volume for antenna 28, the shape of antenna 28 may be adjusted accordingly (e.g., so that the antenna has a cross-sectional outline that lies within the small interior volume). If desired, device 10 may have sidewalls that are not curved (e.g., planar and perpendicular sidewall structures).

Antenna 28 may, if desired, include metal or other conductive material such as conductive structures 52. Conductive structures 52 may be supported by support structures 58. Support structures 58 may be formed from a dielectric such as plastic, glass, or ceramic, and may, if desired, have one or more air-filled interior cavities such as air-filled chamber 108. Conductive structures 52 may form a loop around axis 40 (i.e., an axis that runs parallel to the Z-axis of FIG. 2). A gap such as gap 50 may be interposed within the loop. Gap 50 may be straight or may have other shapes (e.g., gap 50 may follow a meandering path). Discrete capacitors and other components may, if desired, bridge gap 50.

Figure 3:
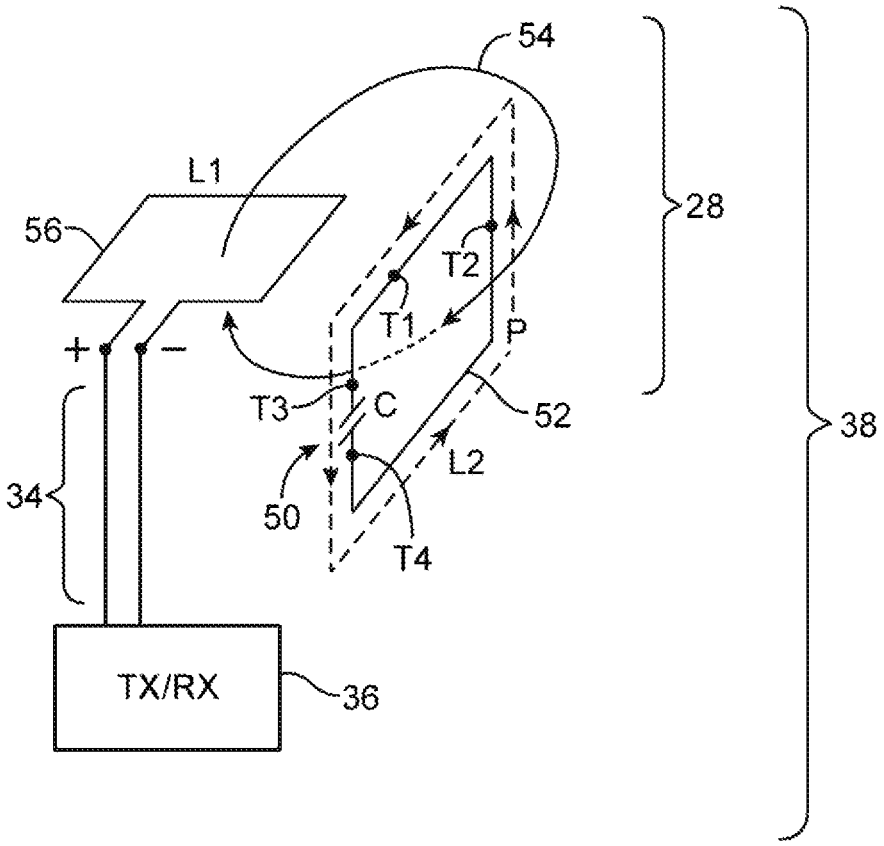
FIG. 3 is a diagram of illustrative wireless circuitry for an electronic device including a transceiver circuit and antenna coupled by a transmission line path in accordance with an embodiment of the present invention.

The conductive loop formed from structures 52 may form a loop antenna resonating element for antenna 28 (i.e., antenna 28 may be a loop antenna). The loop antenna resonating element may be fed directly or indirectly. As shown in FIG. 3, for example, loop antenna resonating element L2 may be indirectly fed using loop-shaped indirect feed structure L1. Feed structure L1 may be formed from a loop of conductive material (loop-shaped conductor 56). As illustrated by electromagnetic fields 54 of FIG. 3, feed structure L1 and loop-shaped antenna resonating element L2 may be coupled using near-field electromagnetic coupling. If desired, loop-shaped antenna resonating element L2 may be directly feed.

Wireless circuitry 38 for electronic device 10 may include radio-frequency transceiver circuitry 36 (e.g., one or more receivers, one or more transmitters, etc.). One or more antennas such as antenna 28 may be used in device 10. Each antenna 28 may be coupled to transceiver circuitry 36 using a radio-frequency communications path such as transmission line 34. Transmission line 34 may include one or more portions of transmission lines such as coaxial cable transmission lines, microstrip transmission lines, stripline transmission lines, edge coupled microstrip transmission lines, edge coupled stripline transmission lines, or other suitable transmission line structures. Transmission line 34 may include one or more portions of different types of transmission line structures (e.g., a segment of coaxial cable, a segment of a microstrip transmission line formed on a printed circuit board, etc.). Transmission line 34 may contain a positive conductor (+) and a ground conductor (−). The conductors in transmission line may be formed from wires, braided wires, strips of metal, conductive traces on substrates, planar metal structures, housing structures, or other conductive structures.

In the illustrative configuration of FIG. 3 in which the (+) and (−) terminals of transmission line 34 are coupled to feed structure L1, antenna resonating element L2 may be indirectly fed. If desired, antenna resonating element L2 may be directly fed by coupling transmission line 34 across pairs of terminals in element L2 such as terminals T1 and T2 or terminals T3 and t4 (as examples). Indirect feeding arrangements for loop antenna 28 may sometimes be described herein as an example. This is, however, merely illustrative. In general, any suitable feeding arrangement may be used for feeding antenna 28 if desired.

Loop antenna 28 may be formed using conductive antenna resonating element structures such as metal traces 52 on a dielectric carrier such as a plastic support structure (e.g., support structures 58). If desired, the conductive structures such as structures 52 that form loop antenna 28 may include wires, metal foil, conductive traces on printed circuit boards, portions of conductive housing structures such as conductive housing walls and conductive internal frame structures, and other conductive structures.

Figure 4:
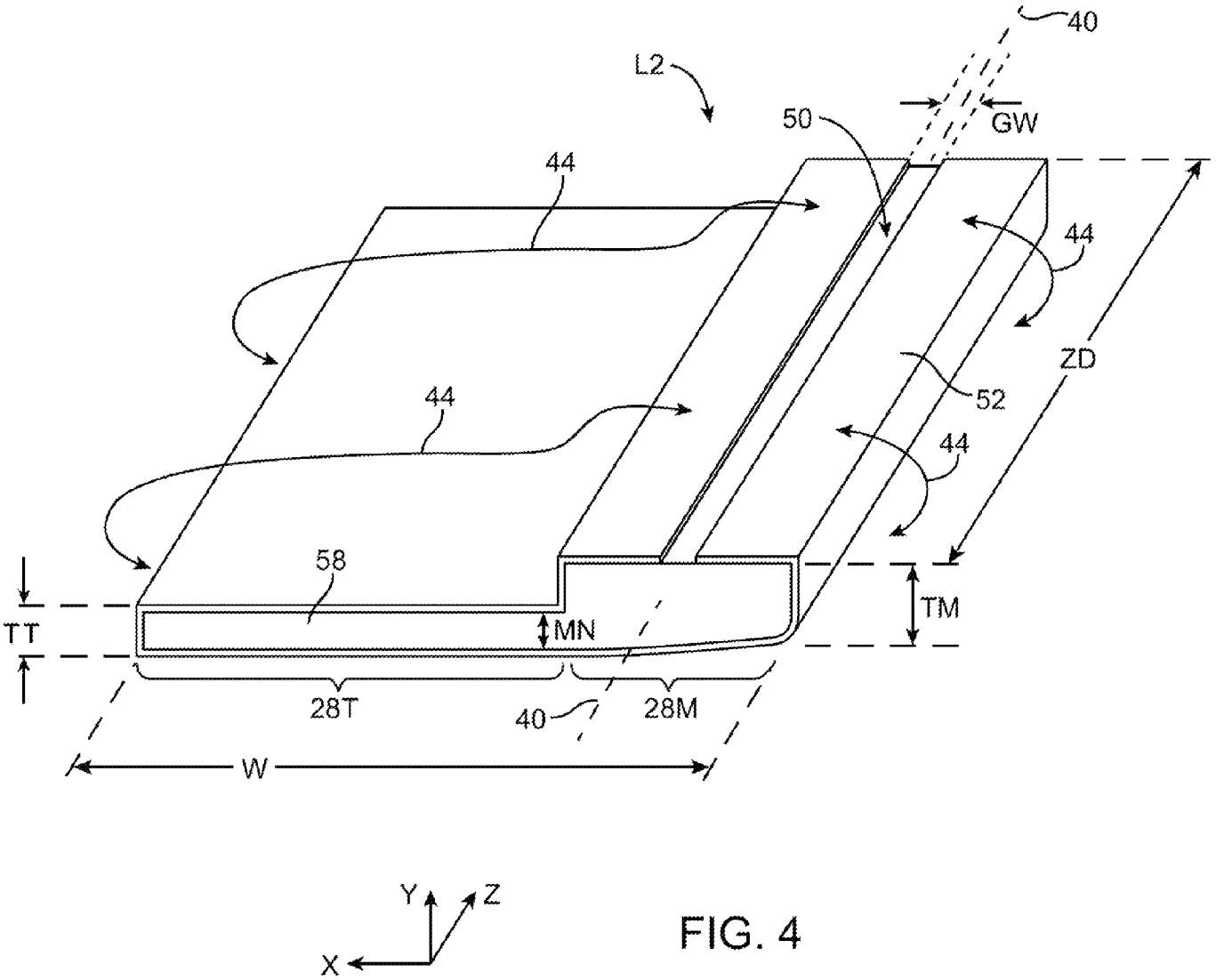
FIG. 4 is a perspective view of conductive structures forming an illustrative antenna resonating element for a distributed loop antenna in accordance with an embodiment of the present invention.

Loop antenna 28 may have resonating element conductive structures that are spread out ("distributed") along the longitudinal axis of loop L2. Loop antenna 28 may therefore sometimes be referred to as a distributed loop antenna. As shown in FIG. 4, antenna resonating element L2 may have a longitudinal axis such as axis 40. Axis 40 may extend parallel to dimension Z of FIG. 4, so dimension Z may sometimes be referred to as the longitudinal axis of loop antenna 28.

Conductive structures 52 in resonating element loop L2 of antenna 28 may include a sheet of conductor that has a first dimension that is wrapped around longitudinal axis 40 and a second dimension ZD that extends along the length of longitudinal axis 40, as shown in FIG. 4. Conductive structures 52 may wrap around axis 40. During operation, antenna currents can flow within sheet 52 around axis 40. In effect, sheet 52 forms a wide strip of conductor in the shape of a loop that is characterized by a perimeter P (see, e.g., perimeter P of FIG. 3). The antenna currents flowing in sheet 52 tend to lie in planes parallel to the X-Y plane of FIG. 4, as indicated by arrows 44. As a result, the "loop" of loop antenna 28 effectively lies in the X-Y plane, whereas the longitudinal axis 40 that runs along the center of the wrapped conductive sheet (sheet 52) lies parallel to the Z-axis (and perpendicular to the X-Y plane of the antenna loop). In a typical installation arrangement, longitudinal axis 40 of antenna 28 may extend parallel to an adjacent edge of housing 12 in electronic device 10.

It may be desirable to form antenna 28 from conductive structures that exhibit a relatively small dimension P. In a loop without any break along periphery P, the antenna may resonate at signal frequencies where the signal has a wavelength approximately equal to P. In compact structures with unbroken loop shapes, the frequency of the communications band covered by antenna 28 may therefore tend to be high. By incorporating a gap or other structure into the loop, a capacitance C can be introduced into antenna 28. With the presence of a capacitance within the perimeter of the loop antenna, the resonant frequency of the antenna may be reduced to a desired frequency of operation without enlarging the perimeter.

Any suitable structure may be used to interpose a capacitance within the loop of conductor formed by conductive sheet 52. For example, one or more gaps such as gap 50 of FIGS. 2, 3, and 4 may be formed. Gap 50 may be filled with dielectric (e.g., a solid dielectric such as plastic, etc. or a dielectric such as air). The gap width GW of gap 50 may affect the value of the capacitance formed by gap 50 (e.g., the capacitance of the gap may tend to increase as gap width GW is decreased). To avoid creating a situation in which the upper portions of sheet 52 are effectively shorted to the lower portions of sheet 52, antenna resonating element L2 (e.g., the tail portion of antenna resonating element L2 associated with antenna tail portion 28T) may be characterized by a minimum separation MN between the upper portion of sheet 52 and the lower portion of sheet 52, as shown in FIG. 4. The magnitude of MN (and therefore the minimum thickness of the tail portion of the antenna) may be, for example, 1 mm, 1.5 mm, 2 mm, or other suitable thickness. The main body portion of antenna 28 may be 3 mm or more, 4 mm or more, 6 mm or more, less than 1 cm, or 1 cm or more (as examples).

Conductive sheet 52 may be formed by metal traces on a dielectric carrier, metal on a wrapped flex circuit, metal foil that has been bent into a desired shape, or other suitable conductive structures. In the example of FIG. 4, metal sheet 52 has a constant dimension ZD as sheet 52 wraps around axis 40. If desired, metal layer 52 may have a dimension ZD parallel to longitudinal antenna axis 40 that varies as a function of position around axis 40 (i.e., ZD need not be constant at all portions of the loop antenna). The FIG. 4 arrangement is merely illustrative.

The size and shape of the conductive structures in antenna 28 influence the frequency response of antenna 28. In some frequencies of operation such as the high band frequencies associated with dual band IEEE 802.11(n) signals, there is a potential for loop antenna resonating element L2 to support undesired waveguide modes that can consume power and thereby decrease high-band efficiency. In resonating element configurations such as resonating element L2 of FIG. 4, additional waveguide modes will be supported if width W of resonating element L2 (i.e., the larger of the two lateral dimensions that are perpendicular to axis 40) is excessive.

Figure 5:
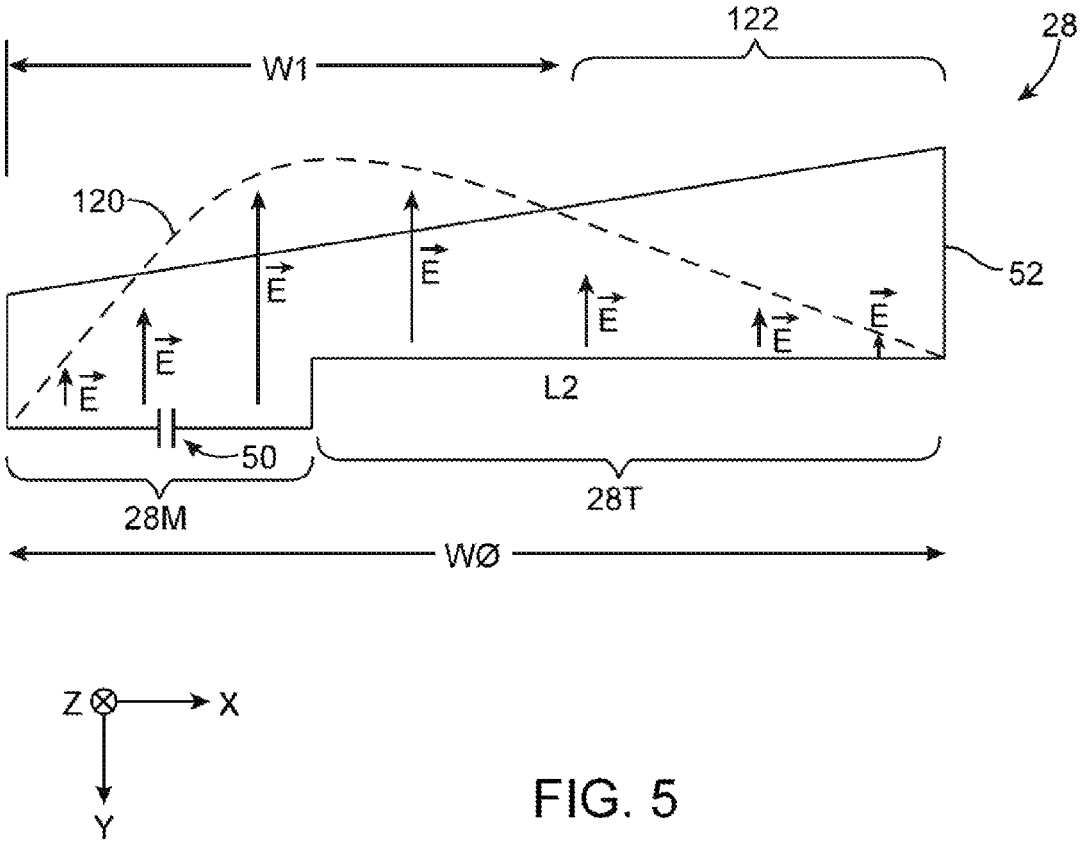
FIG. 5 is a cross-sectional end view of an illustrative distributed loop antenna having a cross-sectional shape with a main body portion and an extending tail portion in accordance with an embodiment of the present invention.

The potential for resonating element L2 to support waveguide modes as a function of various sizes of width W is illustrated in connection with FIGS. 5 and 6. FIG. 5 is a cross-sectional side view of a configuration for loop-based antenna resonating element L2 in which element L2 has a width W0. The thickness (i.e., the vertical dimension perpendicular to width W0 and the Z axis) of main portion 28M is greater than the thickness of extended tail portion 28T, but both may be considered to form portions of a common cavity with the potential to support waveguide modes if sufficiently wide. As illustrated by line 120, which represents electric field strength as a function of position within the antenna, element L2 of length W0 may support a TE10 waveguide mode (i.e., a first order transverse electric mode). In this configuration, some of the radio-frequency energy associated with the antenna will not be radiated, but rather will propagate within the waveguide structure formed by conductive structures 52, thereby reducing antenna efficiency.

To minimize efficiency losses due to waveguide modes, the size of antenna resonating element L2 may be shortened to width W1 by removing structures 122 in the portion of antenna resonating element L2 that is associated with tail portion 28T.

Figure 6:
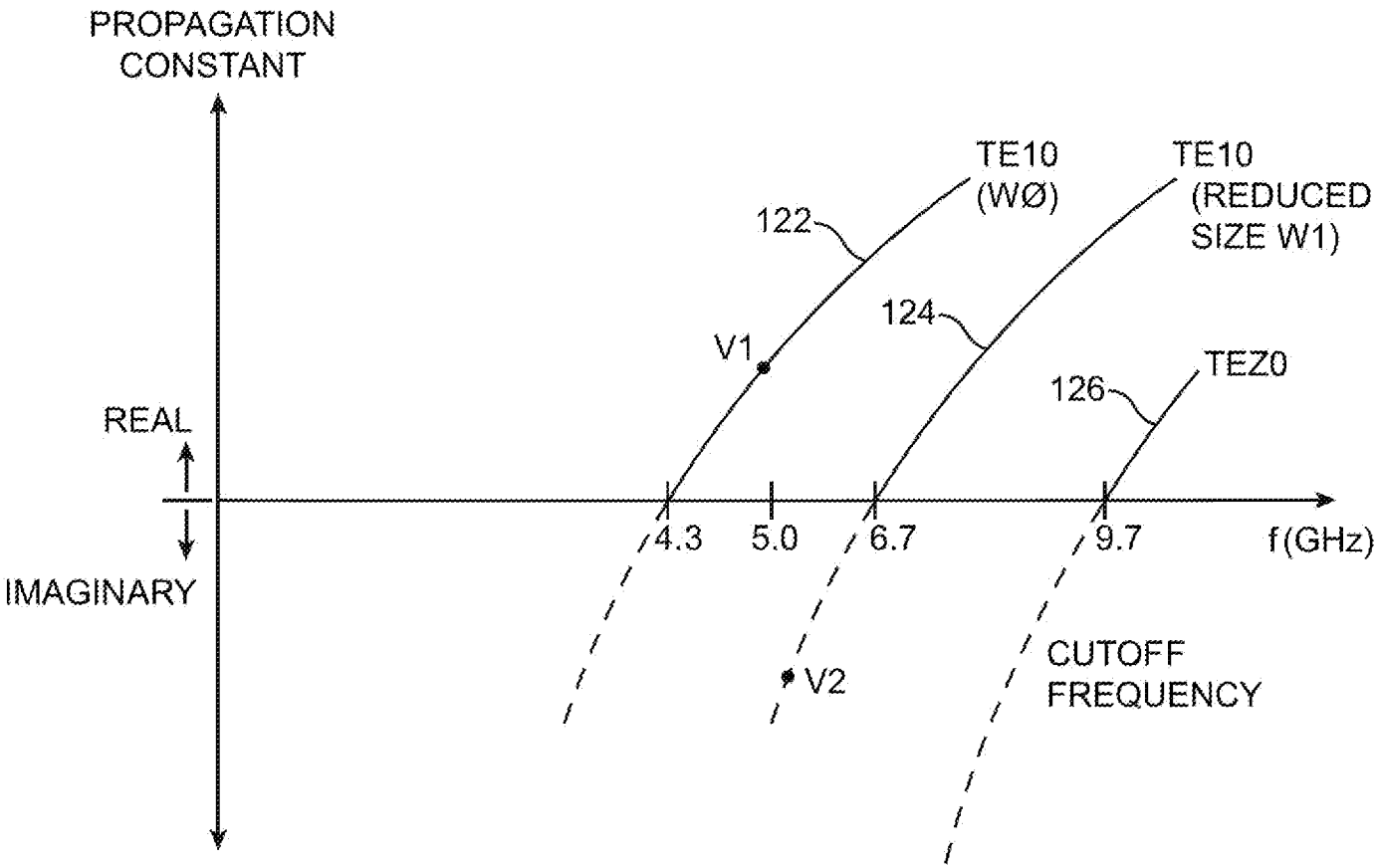
FIG. 6 is a graph in which propagation constant has been plotted as a function of cutoff frequency for antenna structures with a tail portion and for antenna structures with a truncated version of the tail in accordance with an embodiment of the present invention.

FIG. 6 is a graph in which waveguide propagation constant for the structures of FIG. 5 have been plotted as a function of operating frequency f. When the propagation constant is real, radio-frequency signals can propagate (i.e., element L2 will support undesired waveguide modes). When the propagation constant is imaginary, radio-frequency signals are attenuated (and antenna performance will tend not to be degraded by the undesired support of waveguide modes because waveguide modes will be cut off). Curve 122 is associated with the TE10 waveguide mode performance of element L2 of FIG. 5 in a configuration in which L2 has a width of W0. As shown in FIG. 6, in this configuration, element L2 exhibits a cutoff frequency of 4.3 GHz. When operated at a high-band frequency such as 5.0 GHz, the value of the propagation constant will be V1. Because V1 is real, antenna 28 will support the TE10 waveguide mode and the efficiency of antenna 28 will be reduced by the presence of TE10 waveguide mode signals. At frequencies f below cutoff frequency 4.3 GHz, the propagation constant will be imaginary, so low-band performance such as performance at a frequency of 2.4 GHz for the low band of an IEEE 802.11(n) system, may be satisfactory.

When performance at a high-band frequency such as 5.0 GHz is desired, it may not be acceptable to use a width of W0 when forming element L2, because this would allow undesired TE10 modes to be supported within element L2. By reducing the size of element L2, however, the TE10 waveguide cutoff frequency for element L2 may be shifted to higher frequencies. In particular, reduction in the width of element L2 to width W1, may result in the propagation constant values of curve 124. As shown in FIG. 6, curve 124 may be characterized by a cutoff frequency of 6.7 GHz (as an example). Signals at a frequency of 5.0 GHz (e.g., high-band signals in an 802.11(n) system), may have a propagation constant of V2. Because propagation constant V2 is imaginary, the TE10 mode will be cut off at 5.0 GHz (i.e., antenna efficiency will not be undesirably reduced due to waveguide-type signal propagation in element L2).

Higher-order modes such as the TE20 mode will not generally be supported in element L2 except at very high frequencies. For example, when the width of element L2 is W0, element L2 may be characterized by a TE20 propagation constant curve such as curve 126. As shown in FIG. 6, curve 126 may have a cutoff frequency of 9.7 GHz (as an example), which is above both low-band and high-band IEEE 802.11(n) bands and other bands typically used in wireless communications (e.g., cellular telephone bands from 700-2100 MHz, the Bluetooth® band at 2.4 GHz, etc.). When the cutoff frequency is 9.7 GHz, element L2 will tend not to support TE20 waveguide propagation for signals at frequencies less than 9.7 GHz. In a configuration for element L2 in which the width of element L2 is W1, the TE20 cutoff frequency will be even larger than 9.7 GHz.

Figure 7:
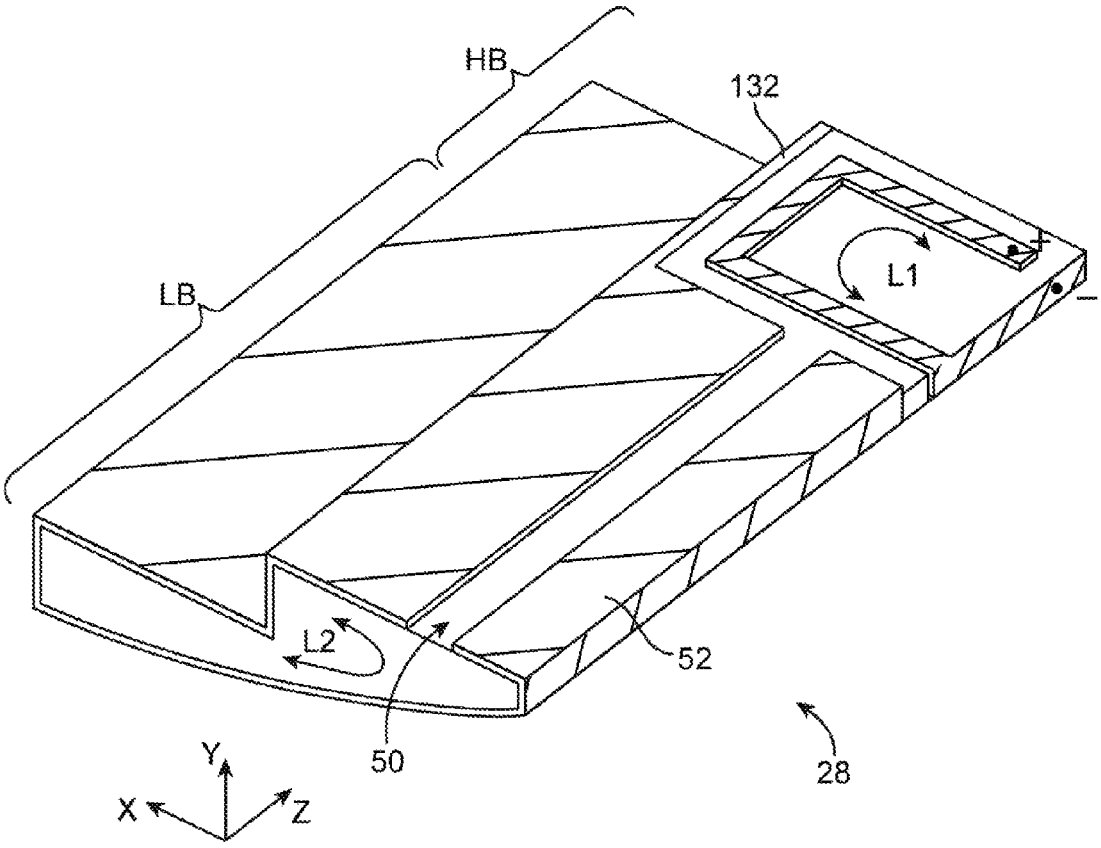
FIG. 7 is a perspective view of an illustrative distributed loop antenna having a main body portion and an extending tail portion in accordance with an embodiment of the present invention.

FIG. 7 is a perspective view of an illustrative configuration that may be used for distributed loop antenna 28. The arrangement shown in FIG. 7 include antenna feed structure L1 and loop antenna resonating element L2. As shown in FIG. 7, support structures 58 may be covered with patterned conductive structures 52. Conductive structures 52 may be patterned to form distributed loop antenna resonating element L2 and loop-shaped antenna feed structure L1. If desired, support structures 58 may be hollow (see, e.g., interior cavity 108 of support structures 58 of FIG. 2). In situations in which support structures 58 have an air-filled cavity such as cavity 108, support structures 58 may have a wall of plastic or other dielectric material that extends around axis 40 under patterned conductive structures 52.

Antenna 28 of FIG. 7 may support dual band operations (e.g., operations at a low band of 2.4 GHz and a high band of 5.0 GHz, or other suitable low and high communications bands). With a configuration of the type shown in FIG. 7, loop antenna resonating element may exhibit a resonance at 2.4 GHz and a second harmonic resonance near 5.0 GHz. Antenna feed element L1 may tend to exhibit a resonance at 5.0 GHz that helps enhance the performance of L2 at 5.0 GHz. With this type of configuration, high-band portion HB of antenna 28 may be primarily used in handling high-band signals (e.g., signals in the 5.0 GHz band) and low-band portion LB may be used in handling low band signals (e.g., signals in the 2.4 GHz band) and some high-band signals.

Figure 8:
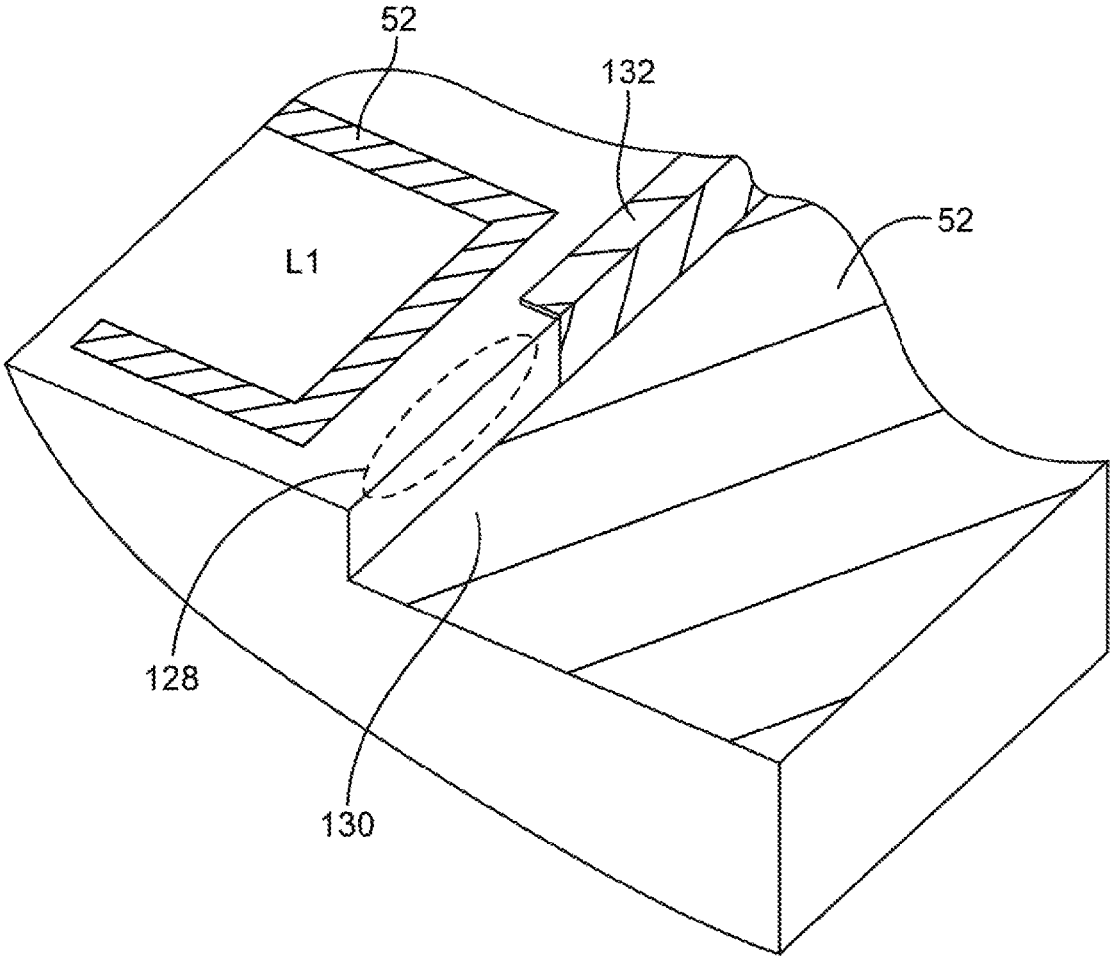
FIG. 8 is a perspective view of a portion of a distributed loop antenna in which a portion of the conductive ground plane structures of the antenna have been removed to form a ground plane recess in the vicinity of a loop-shaped indirect antenna feeding element in accordance with an embodiment of the present invention.

Portion 132 of antenna 28 in high band section HB may help couple element L1 and L2 (and may therefore help element L1 serve as a satisfactory indirect feeding structure for antenna 28). Nevertheless, excessive conductive material in portion 132 may give rise to a possibility that portion HB of antenna 28 will support undesired waveguide modes that could reduce antenna efficiency. As shown in FIG. 8, this possibility can be reduced by removing some of conductive structures 52 in the vicinity of element L1. For example, portions of conductive structures 132 in region 128 near ground plane portion 130 of structures 52 may be removed from antenna 28 to produce a recessed ground plane portion 130. The presence of the recess in ground plane 130 may increase the cutoff frequency for signals in high band portion HB and reduce the likelihood of supporting undesired waveguide modes in high band portion HB.

Figure 9:
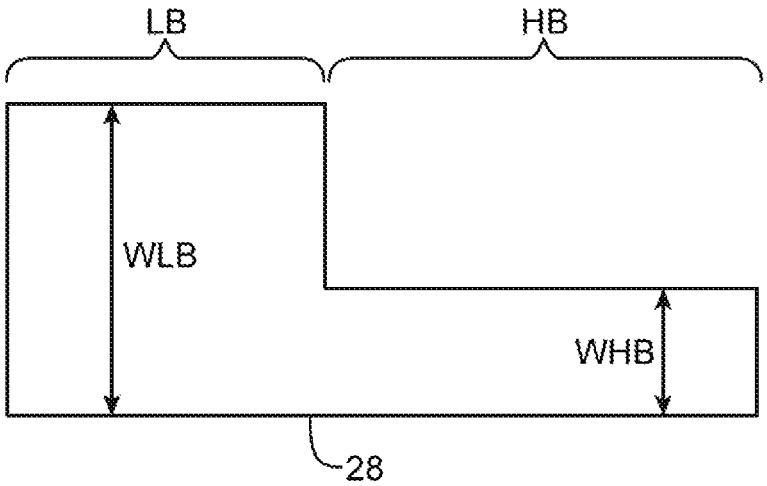
FIG. 9 is a top view of a portion of a loop antenna having high band and low band portions of different sizes in accordance with an embodiment of the present invention.
Figure 10:
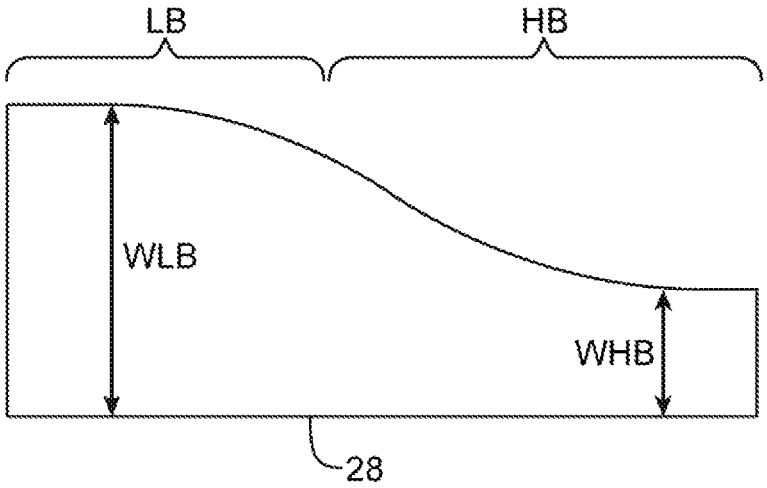
FIG. 10 is a top view of a portion of a loop antenna having high band and low band portions of different sizes that are joined by a continuously varying section in accordance with an embodiment of the present invention.

Another way to ensure that waveguide modes are cut off effectively at operating frequencies of interest in the high band portion of antenna 28 involves locally changing the dimension (width) W of antenna 28 in the low band and high band portions of antenna 28. As shown in the top view of the illustrative configuration of FIG. 9, for example, antenna 28 may be provided with a low band portion that has a larger width (WLB) and a high band portion that has a smaller width (WHB<WLB). The smaller size of WHB relative to WLB may help cut off waveguide modes in high band portion HB of antenna 28. In the FIG. 10 example, there is a gradual change in width between the low band and high band portions of antenna 28. The arrangements of FIGS. 9 and 10, other configurations that selectively vary the size (e.g., the lateral width dimension perpendicular to axis 40 and/or the lateral thickness dimension perpendicular to axis 40) of antenna 28 in the vicinities of elements L1 and L2 may be used with or without using localized metal removal arrangements such as the arrangement of FIG. 8.

Another way in which to ensure that waveguide modes are cut off at desired operating frequencies involves control of the effective dielectric constant $\in_r$ of the environment surrounding conductive structures 52 (e.g., the effective dielectric constant of support structures 58 and cavity 108). The cutoff frequency $f_{cutoffTE10}$ for the TE10 waveguide mode in antenna 28 may be given by equation 1.

$$f_{cutoffTE10}=[2W(\mu_c\in_o\in_r)^{1/2}]^{-1} \quad (1)$$

In equation 1, W is the width of antenna structure 28 (i.e., in a configuration in which the width W is larger than the thickness of antenna structures 28), $\mu_o$ is the permeability of free space, $\in_o$ is the permittivity of free space, and $\in_r$ is the relative permittivity (sometimes referred to as the dielectric constant) of structure 28 in the vicinity of structures 58. An example of a material for forming structures 58 is plastic (e.g., PC/ABS, which is a blend of polycarbonate and acrylonitrile butadiene styrene plastics). With this type of dielectric material, the relative permittivity of structures 58 may be about 2.9

(as an example). The permittivity of structures 58 may be decreased by enlarging cavity 108 and may be decreased by decreasing cavity 108. Different materials and support structure shapes may also be used to adjust the relative permittivity of the support structures used in forming antenna 28. Adjustments to the value of $\in_r$ may be made locally (e.g., so that antenna 28 has a lower values of $\in_r$ in high band portion HB than in low band portion LB) in combination with making localized adjustments such as localized width adjustments (adjustments to W), and/or adjustments to the amount of metal near element L1 (e.g., to remove and/or include metal in region 128 of FIG. 8).

An example of a size for W that may be used in antenna 28 to support operation at 2.4 GHz is 20 mm. This value may be too large for maximized efficiency when operating at 5.0 GHz. To ensure that antenna 28 operates satisfactorily, it may therefore be desirable to reduce $\in_r$, remove metal from portion 128 of structures 52 (as described in connection with FIG. 8), and/or to reduce W in region HB of antenna 28.

The use of a relatively large perimeter value P for antenna 28 may allow the value of C to be decreased (for a given efficiency). The ability of C to be decreased may allow the width GW (FIG. 4) of gap 50 to be increased. Gap 50 may serve as an aperture for antenna 28, so larger gap sizes GW may help improve efficiency and bandwidth for antenna 28.

There is generally a tradeoff between low band and high band performance. For satisfactory low band performance, larger values of perimeter P may be desirable to allow smaller C values and larger GW values. For satisfactory high band performance, excessively large W values (helpful for enlarging P) cannot be used without giving rise to a risk of supporting undesired waveguide modes that can consume power and decrease high band efficiency.

One possible design for antenna 28 involves the use of a compromise size for W. As an example, a value of W of about 15 mm may be sufficient to ensure that high band waveguide modes are cut off, without decreasing perimeter P excessively. Antenna width W may have other values if desired (e.g., greater than 10 mm, greater than 12 mm, 12-19 mm, etc.).

The need to compromise on design parameters such as width W may be minimized by using locally varying structures in antenna 28, such as localized variations in lateral dimension W and/or localized variations in $\in_r$ (by locally varying the composition of the material used in forming structures 58, and/or by locally varying the size of chamber 108—e.g., by enlarging the size of chamber 108 in high band region HB so that structures 58 are thinner in region HB than in region LB). Localized changes such as removing metal from region 128 in high band portion HB of antenna 28 may also be used.

By changing $\in_r$, W, and other antenna attributes as a function of length along axis 40 of antenna 28, efficiency can be maximized. Tail portion 28T of antenna 28 may protrude under components such as display module 104, thereby allowing perimeter P to be relatively large and allowing gap width GW to be relatively large, even when antenna 28 is installed in a device such as device 10 of FIG. 1 in which interior volume for mounting antennas is scarce. At the same time, localized changes in antenna 28 and/or appropriate selection of attributes (e.g., $\in_r$, W, etc.) may help ensure that undesired waveguide modes are not supported so as to enhance antenna efficiency.

The foregoing is merely illustrative of the principles of this invention and various modifications can be made by those skilled in the art without departing from the scope and spirit of the invention.

What is claimed is:

1. A loop antenna configured to operate in at least one communications band, comprising:

a loop antenna resonating element formed from a sheet of conductive material that is wrapped around an axis to form a conductive loop, wherein the loop antenna resonating element has a main body portion and an extended tail portion, and the main body portion and the extended tail portion are configured so that the loop antenna does not support waveguide modes for signals in the at least one communications band;

a dielectric support structure on which the sheet of conductive material is formed that supports the sheet of conductive material and comprises a wall of dielectric material that extends around the axis to surround a cavity, wherein the wall is characterized by a thickness that has different thickness values at different positions along the axis; and an antenna feed structure that that is configured to indirectly feed the loop antenna resonating element, wherein the antenna feed structure comprises a loop-shaped metal trace on the dielectric support structure, and the sheet of conductive material has a ground plane recess adjacent to the loop-shaped metal trace.

2. The loop antenna defined in claim 1 wherein the loop antenna resonating element is characterized by a width perpendicular to the axis and wherein the width has different values at different positions along the axis.

3. The loop antenna defined in claim 1 wherein the loop antenna resonating element is characterized by a width perpendicular to the axis, wherein the main body portion is characterized by a first thickness perpendicular to the width and the axis, wherein the extended tail portion is characterized by a second thickness perpendicular to the width and the axis, and wherein the second thickness is less than the first thickness.

4. The loop antenna defined in claim 3 wherein the second thickness is at least 1 mm.

5. The loop antenna defined in claim 4 wherein the width is greater than 10 mm.

6. A loop antenna configured to operate in at least one communications band, comprising:

a loop antenna resonating element formed from a sheet of conductive material that is wrapped around an axis to form a conductive loop, wherein the loop antenna resonating element comprises dielectric support structures that support the sheet of conductive material, the loop antenna resonating element has a main body portion and an extended tail portion, and the main body portion and the extended tail portion are configured so that the loop antenna does not support waveguide modes for signals in the at least one communications band; and an antenna feed structure that is configured to indirectly feed the loop antenna resonating element using near-field electromagnetic coupling, wherein the antenna feed structure comprises a loop-shaped metal trace on the dielectric support structure, the sheet of conductive material has a ground plane recess adjacent to the loop-shaped metal trace, and the feed structure is configured to exhibit resonance at frequencies of the at least one communications band supported by the loop antenna resonating element.

7. The loop antenna defined in claim 6 wherein the conductive loop has a perimeter, wherein the sheet of material has at least one gap with an associated capacitance that is interposed within the perimeter, wherein the support structure comprises a plastic structure with an air-filled cavity.

8. The loop antenna defined in claim 7 wherein the at least one communications band comprises a 2.4 GHz communications band.

9. The loop antenna defined in claim 8 wherein the loop antenna resonating element is configured to operate in the 2.4 GHz communications band and is configured to operate in a 5 GHz communications band.

10. A loop antenna configured to operate in at least one communications band, comprising:

a loop antenna resonating element formed from a sheet of conductive material that is wrapped around an axis to form a conductive loop, wherein the loop antenna resonating element has a main body portion and an extended tail portion, and the main body portion and the extended tail portion are configured so that the loop antenna does not support waveguide modes for signals in the at least one communications band; and an antenna feed structure that comprises a loop shaped structure and that is configured to indirectly feed the loop antenna resonating element, wherein the loop shaped structure comprises a metal trace on a dielectric support structure, the sheet of conductive material is supported by the support structure, and the sheet of material has a ground plane recess adjacent to the loop-shaped structure.

11. The loop antenna defined in claim 10 wherein the main body portion is used to transmit and receive signals in a first communications band, wherein the extended tail portion is used to transmit and receive signals in a second communications band, and wherein the first communications band is a lower frequency band than the second communications band.

12. The loop antenna defined in claim 10 further comprising:

a dielectric support structure on which the sheet of conductive material is formed.

13. The loop antenna defined in claim 12 wherein the dielectric support structure comprises walls that surround a cavity.

14. The loop antenna defined in claim 13 wherein the walls are characterized by a thickness, and the thickness has different values at different positions along the axis.

* * * * *